US005355863A

United States Patent [19]

Yamanaka et al.

[11] Patent Number: 5,355,863

[45] Date of Patent: Oct. 18, 1994

[54] EVAPORATIVE FUEL-PROCESSING SYSTEM FOR INTERNAL COMBUSTION ENGINES

[75] Inventors: Masayoshi Yamanaka; Hiroshi Maruyama; Takeshi Suzuki; Kazutomo Sawamura; Shigetaka Kuroda, all of Wako, Japan

[73] Assignee: Honda Giken Kogyo Kabushiki Kaisha, Tokyo, Japan

[21] Appl. No.: 159,548

[22] Filed: Dec. 1, 1993

[30] Foreign Application Priority Data

Dec. 2, 1992 [JP] Japan ..... 4-349803

[51] Int. Cl.[5] ..... F02M 33/02; F02B 77/00

[52] U.S. Cl. ..... 123/520; 123/198 D

[58] Field of Search ..... 123/198 D, 520, 521, 123/519, 518, 516

[56] References Cited

U.S. PATENT DOCUMENTS

| | | | |
|---|---|---|---|
| 4,949,695 | 8/1990 | Uranishi | 123/520 |
| 5,158,054 | 10/1992 | Otsuka | 123/198 D |
| 5,193,512 | 3/1993 | Steinbrenner | 123/520 |
| 5,253,629 | 10/1993 | Fornuto | 123/519 |
| 5,263,461 | 11/1993 | Fujimoto | 123/198 D |
| 5,269,277 | 12/1993 | Kuroda | 123/198 D |
| 5,275,144 | 1/1994 | Gross | 123/198 D |
| 5,295,472 | 3/1994 | Otsuka | 123/520 |

FOREIGN PATENT DOCUMENTS 5-180093 7/1993 Japan .

*Primary Examiner*—Carl S. Miller

*Attorney, Agent, or Firm*—Nikaido, Marmelstein, Murray & Oram

[57] ABSTRACT

An evaporative fuel-processing system for an internal combustion engine includes an evaporative emission control system having a canister, a first passage connecting between the canister and a fuel tank, a second passage connecting between the canister and the intake system of the engine, and a purge control valve arranged across the second passage, a drain shut valve for opening and closing an inlet port of the canister, and pressure sensors for detecting pressure within the evaporative emission control system. The evaporative emission control system is negatively pressurized by introducing negative pressure from the intake system into the evaporative emission control system by opening the purge control valve and closing the drain shut valve, to thereby bring the evaporative emission control system into a predetermined negatively pressurized state, and then closing the purge control valve to complete the negative pressurization. Presence/absence of a leak from the system is detected based on a rate of decrease in negative pressure within the evaporative emission control system after the closing of the purge control valve. The leak detection is started when the pressure within the evaporative emission control system becomes substantially equal throughout the system after the completion of the negative pressurization.

8 Claims, 14 Drawing Sheets

EVAPORATIVE FUEL-PROCESSING SYSTEM FOR INTERNAL COMBUSTION ENGINES

BACKGROUND OF THE INVENTION

1. Field of the Invention

This invention relates to an evaporative fuel-processing system for internal combustion engines, and more particularly to an evaporative fuel-processing system which has a function of detecting presence/absence of a leak from an evaporative emission control system of the engine.

2. Prior Art

Conventionally, evaporative fuel-processing systems for internal combustion engines have been widely used, which are so constructed that evaporative fuel generated in a fuel tank is temporarily stored in a canister and the thus stored evaporative fuel is suitably purged into an intake system of the engine.

To detect an abnormality occurring in an evaporative emission control system which is comprised of the canister, a passage connecting the canister and the fuel tank of the engine, a passage connecting between the canister and the intake system of the engine, the present assignee has already proposed a method which comprises negatively pressurizing the evaporative emission control system by means of negative pressure from the intake system of the engine, disconnecting the evaporative emission control system from the intake system of the engine when the evaporative emission control system has been properly negatively pressurized, and detecting presence/absence of a leak, based on a change in the pressure within the evaporative emission control system, for example, by Japanese Provisional Patent Publication (Kokai) No. 5-180093 to which U.S. Ser. No. 07/942,875 corresponds.

In the above proposed method, a pressure sensor is mounted in the fuel tank to detect pressure therein (tank internal pressure PT), and the evaporative emission control system is disconnected from the intake system of the engine at a time point the tank internal pressure PT is reduced to a predetermined negative pressure P1 (at a time point t4 at (d) in FIG. 2), followed by detecting the presence/absence of a leak, based on a rate of increase in the tank internal pressure, which is detected over a predetermined time period elapsed after the disconnection. Therefore, the proposed method has the following problem:

When the tank internal pressure PT decreases to the predetermined negative pressure P1, the pressure within the canister has already dropped to a value lower than the pressure P1 (see (d) in FIG. 2), so that the tank internal pressure PT continues to decrease even after the time point t4, and starts to increase only after a time point t5. As a result, if the rate of increase in the tank internal pressure is calculated based on the tank internal pressure PT detected at the time point t4, the resulting increase rate value is smaller than a normally required increase rate value (rate of increase between the time points t5 and t6), or the tank internal pressure at the time point t6 is lower than the predetermined negative pressure P1, which makes it impossible to detect a small degree of leak.

SUMMARY OF THE INVENTION

It is the object of the invention to provide an evaporative fuel-processing system which is capable of more accurately detecting presence/absence of a leak from an evaporative emission control system of an internal combustion engine.

To attain the above object, the present invention provides an evaporative fuel-processing system for an internal combustion engine having a fuel tank, and an intake system, including an evaporative emission control system having a canister having an air inlet port formed therein and communicating with the atmosphere, the canister accommodating activated carbon for adsorbing evaporative fuel generated within the fuel tank, a first passage connecting between the canister and the fuel tank, a second passage connecting between the canister and the intake system of the engine, and a purge control valve arranged across the second passage, a drain shut valve for opening and closing the inlet port of the canister, pressure-detecting means for detecting pressure within the evaporative emission control system, negatively pressurizing means for negatively pressurizing the evaporative emission control system by introducing negative pressure from the intake system of the engine into the evaporative emission control system by opening the purge control valve and closing the drain shut valve, to thereby bring the evaporative emission control system into a predetermined negatively pressurized state, and then closing the purge control valve to complete the negative pressurization, and leak-detecting means for detecting presence/absence of a leak from the evaporative emission control system, based on a rate of decrease in negative pressure within the evaporative emission control system after the closing of the purge control valve.

The evaporative fuel-processing system according to the invention is characterized by comprising delay means for causing the leak-detecting means to start operating when the pressure within the evaporative emission control system becomes substantially equal throughout the evaporative emission control system after the completion of the negative pressurization by the negatively pressurizing means.

In a preferred embodiment of the invention, the delay means causes the leak-detecting means to start operating when a predetermined delay time period elapses after the completion of the negative pressurization by the negatively pressurizing means, the predetermined delay time period being equal to a time period within which the pressure within the evaporative emission control system can become substantially equal throughout the evaporative emission control system after the completion of the negative pressurization.

Preferably, the pressure-detecting means comprises at least one of tank internal pressure-detecting means for detecting pressure within the fuel tank and canister internal pressure-detecting means for detecting pressure within the canister.

Specifically, the predetermined delay time period is equal to a time period within which the pressure within the fuel tank detected by the tank internal pressure-detecting means and the pressure within the canister detected by the canister internal pressure-detecting means can become substantially equal to each other after the completion of the negative pressurization by the negatively pressuring means.

In another embodiment of the invention, the pressure-detecting means comprises tank internal pressure-detecting means for detecting pressure within the fuel tank, the delay means causing the leak-detecting means to start operating when a change in the pressure within the fuel tank detected by the tank internal pressure-detecting means changes in direction from a negative direction to a positive direction after the completion of the negative pressurization by the negatively pressuring means.

Preferably, the negatively pressurizing means operates until the pressure within the evaporative emission control system detected by the pressure-detecting means becomes lower by a predetermined pressure value than a value of the pressure within the evaporative emission control system assumed when an interior of the evaporative emission control system is open to the atmosphere.

Preferably, the leak-detecting means detects presence/absence of a leak from the evaporative emission control system, based on a value of the pressure within the evaporative emission control system assumed at the start of operation of the leak-detecting means and a value of the pressure within the evaporative emission control system assumed after a predetermined time period elapses after the start of operation of the leak-detecting means.

More preferably, the pressure-detecting means comprises tank internal pressure-detecting means for detecting pressure within the fuel tank, and canister internal pressure-detecting means for detecting pressure within the canister, the evaporative emission control system further including canister internal pressure control means responsive to an output from the tank internal pressure-detecting means and an output from the canister internal pressure control means, for controlling the pressure within the canister to a predetermined lower limit value thereof when the pressure within the fuel tank detected by the tank internal pressure-detecting means is higher than a predetermined value.

The above and other objects, features, and advantages of the invention will be more apparent from the following detailed description taken in conjunction with the accompanying drawings.

DETAILED DESCRIPTION

The invention will now be described in detail with reference to the drawings showing embodiments thereof.

Figure 1:
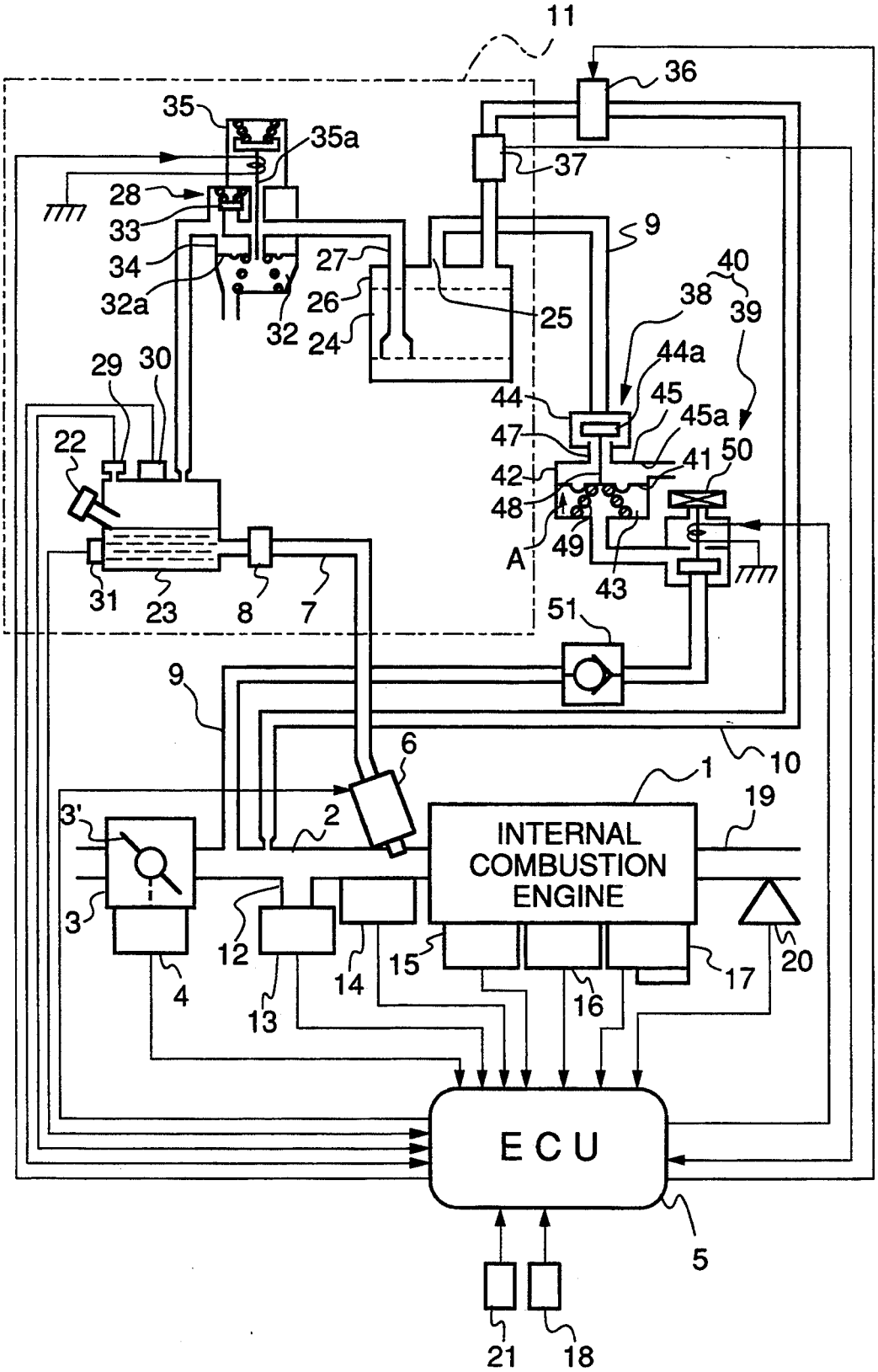
FIG. 1 is a block diagram showing the whole arrangement of an internal combustion engine and an evaporative fuel-processing system therefor, according to an embodiment of the invention.

Referring first to FIG. 1, there is illustrated the whole arrangement of an internal combustion engine installed in an automotive vehicle and an evaporative fuel-processing system therefor according to an embodiment of the invention.

In the figure, reference numeral 1 designates an internal combustion engine (hereinafter simply referred to as "the engine") having four cylinders, not shown, for instance. Connected to the cylinder block of the engine 1 is an intake pipe 2 across which is arranged a throttle body 3 accommodating a throttle valve 3' therein. A throttle valve opening ($\theta$TH) sensor 4 is connected to the throttle valve 3' for generating an electric signal indicative of the sensed throttle valve opening and supplying same to an electronic control unit (hereinafter referred to as "the ECU") 5.

Fuel injection valves 6, only one of which is shown, are inserted into the interior of the intake pipe 2 at locations intermediate between the cylinder block of the engine 1 and the throttle valve 3' and slightly upstream of respective intake valves, not shown. The fuel injection valves 6 are connected to a fuel pump 8 via a fuel supply pipe 7, and electrically connected to the ECU 5 to have their valve opening periods controlled by signals therefrom.

A negative pressure communication passage 9 and a purging passage 10 open into the intake pipe 2 at respective locations downstream of the throttle valve 3', both of which are connected to an evaporative emission control system 11, referred to hereinafter.

Further, an intake pipe absolute pressure (PBA) sensor 13 is provided in communication with the interior of the intake pipe 2 via a conduit 12 opening into the intake passage 2 at a location downstream of an end of the purging passage 10 opening into the intake pipe 2 for supplying an electric signal indicative of the sensed absolute pressure within the intake pipe 2 to the ECU 5.

An intake air temperature (TA) sensor 14 is inserted into the intake pipe 2 at a location downstream of the conduit 12 for supplying an electric signal indicative of the sensed intake air temperature TA to the ECU 5.

An engine coolant temperature (TW) sensor 15 formed of a thermistor or the like is inserted into a coolant passage filled with a coolant and formed in the cylinder block, for supplying an electric signal indicative of the sensed engine coolant temperature TW to the ECU 5.

An engine rotational speed (NE) sensor 16 is arranged in facing relation to a camshaft or a crankshaft of the engine 1, neither of which is shown. The engine rotational speed sensor 16 generates a pulse as a TDC signal pulse at each of predetermined crank angles whenever the crankshaft rotates through 180 degrees, the pulse being supplied to the ECU 5.

A transmission 17 is connected between wheels of a vehicle, not shown, and an output shaft of the engine 1, for transmitting power from the engine 1 to the wheels.

A vehicle speed (VSP) sensor 18 is mounted on one of the wheels, for supplying an electric signal indicative of the sensed vehicle speed VSP to the ECU 5.

An oxygen concentration ($O_2$) sensor 20 is inserted into an exhaust pipe 19 extending from the engine 1, for supplying an electric signal indicative of the sensed oxygen concentration to the ECU 5.

An ignition switch (IGSW) sensor 21 detects an ON (closed) state of an ignition switch IGSW, not shown, to detect that the engine 1 is in operation, and supplies an electric signal indicative of the ON state of the ignition switch IGSW to the ECU 5.

The evaporative emission control system 11 is comprised of a fuel tank 23 having a filler cap 22 which is removed for refueling, a canister 26 containing activated carbon 24 as an adsorbent and having an air inlet port 25 provided in an upper wall thereof, an evaporative fuel-guiding passage (first passage) 27 connecting the canister 26 to the fuel tank 23, a two-way valve 28 arranged across the evaporative fuel-guiding passage 27, a purging passage (second passage) 10 connecting the canister 26 to the intake pipe 2, and a purge control valve 36 and a hot wire-type flowmeter 37 which are both arranged across the purging passage 10.

The fuel tank 23 is connected to the fuel injection valves 6 via the fuel pump 8 and the fuel supply pipe 7, and has a tank internal pressure (PT) sensor (hereinafter referred to as "the PT sensor") 29 and a fuel amount (FV) sensor 30, both mounted at an upper wall thereof, and a fuel temperature (TF) sensor 31 as a tank temperature-detecting means mounted at a lateral wall thereof. *The PT sensor 29, the FV sensor 30, and the TF sensor 31 are electrically connected to the ECU 5. The PT sensor 29 senses the pressure (tank internal pressure) PT within the fuel tank 23 and supplies an electric signal indicative of the sensed tank internal pressure PT to the ECU 5. The FV sensor 30 senses the volumetric amount of fuel within the fuel tank 23 and supplies an electric signal indicative of the sensed volumetric amount of fuel to the ECU 5. The TF sensor 31 senses the temperature of fuel within the fuel tank 23 and supplies an electric signal indicative of the sensed fuel temperature TF to the ECU 5.

The two-way valve 28 is formed of a positive pressure valve 32 and a negative pressure valve 33. The positive pressure valve 32 has a diaphragm 32*a* to which is connected a rod 35*a* of an electromagnetic driving unit 35. The electromagnetic driving unit 35 is electrically connected to the ECU 5 such that the operation of the two-way valve 28 is controlled by a signal supplied from the ECU 5. More specifically, when the electromagnetic driving unit 35 is energized, the positive pressure valve 32 of the two-way valve 28 is forcedly opened to open the two-way valve 28, whereas when the electromagnetic driving unit 35 is deenergized, the two-way valve 28 is opened only when a difference in pressure between the canister 26 side and the fuel tank 23 side of the valve 28 exceeds a predetermined value.

The purge control valve 36 is arranged across the purging passage 10 extending from the canister 26, which valve has a solenoid, not shown, electrically connected to the ECU 5. The purge control valve 36 is controlled by a signal supplied from the ECU 5 to linearly change the opening thereof. That is, the ECU 5 supplies a desired amount of control current to the purge control valve 36 to control the opening thereof.

The hot wire-type flowmeter (mass flowmeter) 37 is arranged across the purging passage 10 at a location between the canister 26 and the purge control valve 36. The flowmeter 37 has a platinum wire, not shown, which is heated by an electric current and cooled by a gas flow flowing in the purging passage 10 to have its electrical resistance reduced. The flowmeter 37 has an output characteristic variable in dependence on the concentration and flow rate of evaporative fuel flowing in the purging passage 10 as well as on the flow rate of a mixture of evaporative fuel and air being purged through the purging passage 10. The flowmeter 37 is electrically connected to the ECU 5 to supply the same with an electric signal indicative of the flow rate of the mixture purged through the purging passage 10.

A drain shut valve 38 is mounted across the negative pressure communication passage 9 connected to the air inlet port 25 of the canister 26 and communication with the atmosphere. The drain shut valve 38 has an air chamber 42 and a negative pressure chamber 43 defined by a diaphragm 41. Further, the air chamber 42 is formed of a first chamber 44 accommodating a valve element 44*a*, a second chamber 45 formed with an air inlet port 45*a*, and a narrowed communication passage 47 connecting the second chamber 45 to the first chamber 44. The valve element 44*a* is connected via a rod 48 to the diaphragm 41. The negative pressure chamber 43 communicates with an electromagnetic valve 39, and has a spring 49 arranged therein for resiliently urging the diaphragm 41 in a direction indicated by the arrow A.

The electromagnetic valve 39 is constructed such that when a solenoid thereof is deenergized, a valve element thereof is in a seated position to allow air to be introduced into the negative pressure chamber 43 via an air inlet port 50 to open the drain shut valve 38, whereas when the solenoid is energized, the valve element is in a lifted position in which the negative pressure chamber 43 communicates with the intake pipe 2 via the communication passage 9 to close the drain shut valve 38. In addition, reference numeral 51 indicates a check valve.

The ECU 5 comprises an input circuit having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU"), memory means storing programs executed by the CPU and for storing results of calculations therefrom, etc., and an output circuit which outputs driving signals to the fuel injection valves 6, the electromagnetic driving unit 35, the electromagnetic valve 39, and the purge control valve 36.

Figure 2:
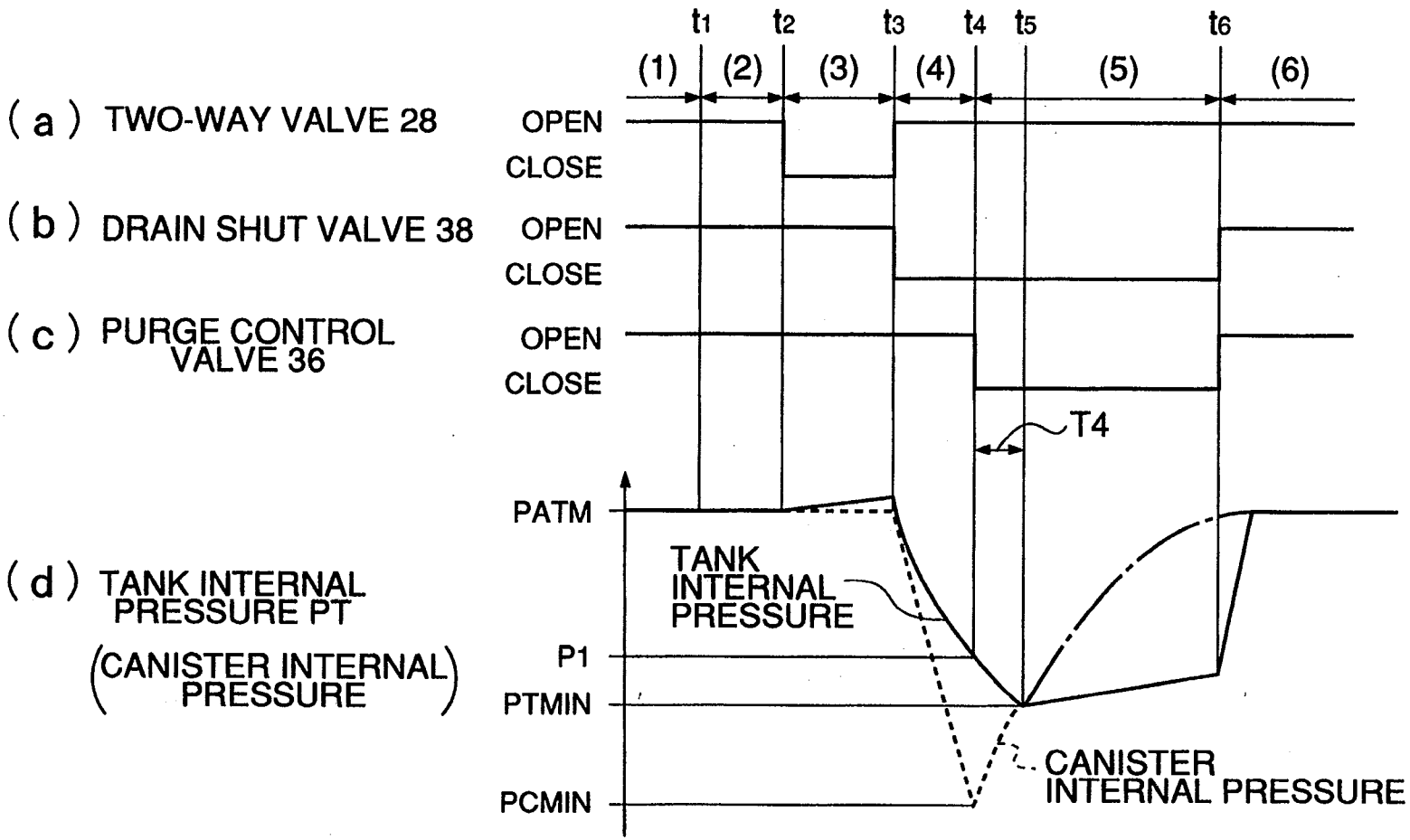
FIG. 2 is a timing chart showing operating patterns of control valves as well as changes in tank internal pressure and pressure within a canister.

FIG. 2 shows patterns of operations of the two-way valve 28, the drain shut valve 38, and the purge control valve 36 performed during a diagnosis of abnormality of the evaporative emission control system 11, and changes in the tank internal pressure PT and pressure PC within the canister 26 occurring during the diagnosis. The operations of these valves are commanded by control signals from the ECU 5.

First, during normal operation (normal purging) of the engine (indicated by (1) in FIG. 2), the electromagnetic driving unit 35 is energized to open the two-way valve 28 and at the same time the drain shut valve 38 is opened. When the ignition switch IGSW is turned on and then the engine is detected to be operating by means of an IGS sensor 18, the purge control valve 36 is energized to open. Then, evaporative fuel generated within the fuel tank 23 is allowed to flow through the evaporative fuel-guiding passage 27 into the canister 26 to be temporarily adsorbed by the adsorbent 24 therein. Since the drain shut valve 38 is open during the normal operation as mentioned above, fresh air is introduced through the air inlet port 45*a* to the canister 26, and evaporative fuel allowed to flow into the canister 26 is purged together with the fresh air through the purging pipe 10 and the purge control valve 36 to the intake pipe 2.

When predetermined abnormality determining conditions, hereinafter described, are satisfied, the two-way valve 28, the drain shut valve 38 and the purge control valve 36 are operated in the following manner to carry out an abnormality diagnosis of the evaporative emission control system 11:

First, the tank internal pressure PT is relieved to the atmosphere, over a time period indicated by (2) in FIG. 2. More specifically, the two-way valve 28 is held in an energized state to maintain communication between the fuel tank 23 and the canister 26, and at the same time the drain shut valve 38 is kept open and the purge control valve 36 is kept open, to thereby relieve the tank internal pressure PT to the atmosphere.

Then, an amount of change in the tank internal pressure PT is measured over a time period indicated by (3) in FIG. 2.

More specifically, the drain shut valve 38 is kept open and the purge control valve 36 is kept open. On the other hand, the two-way valve 28 is turned into a closed state, i.e. the electromagnetic driving unit 35 is turned off, to thereby measure an amount of change in the tank internal pressure occurring after the fuel tank 23 has ceased to be open to the atmosphere for the purpose of checking an amount of evaporative fuel generated in the fuel tank 23.

Then, the evaporative emission control system 11 is negatively pressurized over a time period indicated by (4) in FIG. 2. More specifically, the purge control valve 36 is held open, while the two-way valve 28 is opened and the drain shut valve 38 is closed, whereby the evaporative emission control system 11 is negatively pressurized by a gas drawing force developed by negative pressure in the purging passage 10 held in communication with the intake pipe 2.

Then, a leak down check is carried out over a time period indicated by (5) in FIG. 2.

More specifically, when the evaporative emission control system 11 is negatively pressurized to a predetermined degree, the purge control valve 36 is closed, and then a change in the tank internal pressure PT occurring with the lapse of time thereafter is checked by the PT sensor 29. If the system does not suffer from a significant leak of evaporative fuel therefrom, the tank internal pressure PT changes as indicated by the solid line, and hence it is determined that the evaporative emission control system 11 is normal. On the other hand, if the system suffers from a significant leak of evaporative fuel therefrom, the tank internal pressure PT approaches to the atmospheric pressure PATM as indicated by the one dot chain line, and hence it is determined that evaporative fuel has leaked from the evaporative emission control system 11 to cause an abnormality therein. In this connection, if the evaporative emission control system 11 cannot be brought into the predetermined negatively pressurized state within a predetermined time period, the leak down check is inhibited, as hereinafter described.

After determining whether or not the system 11 is abnormal, the system 11 returns to the normal purging mode, as indicated by (6) in FIG. 2.

More specifically, while the two-way valve 28 is held open, the drain shut valve 38 is opened, and the purge control valve 36 is opened, to thereby perform normal purging of the evaporative fuel. In this state, the tank internal pressure PT is relieved to the atmosphere and hence becomes substantially equal to the atmospheric pressure.

Next, the manner of abnormality diagnosis of the evaporative emission control system 11 will be described.

Figure 3:
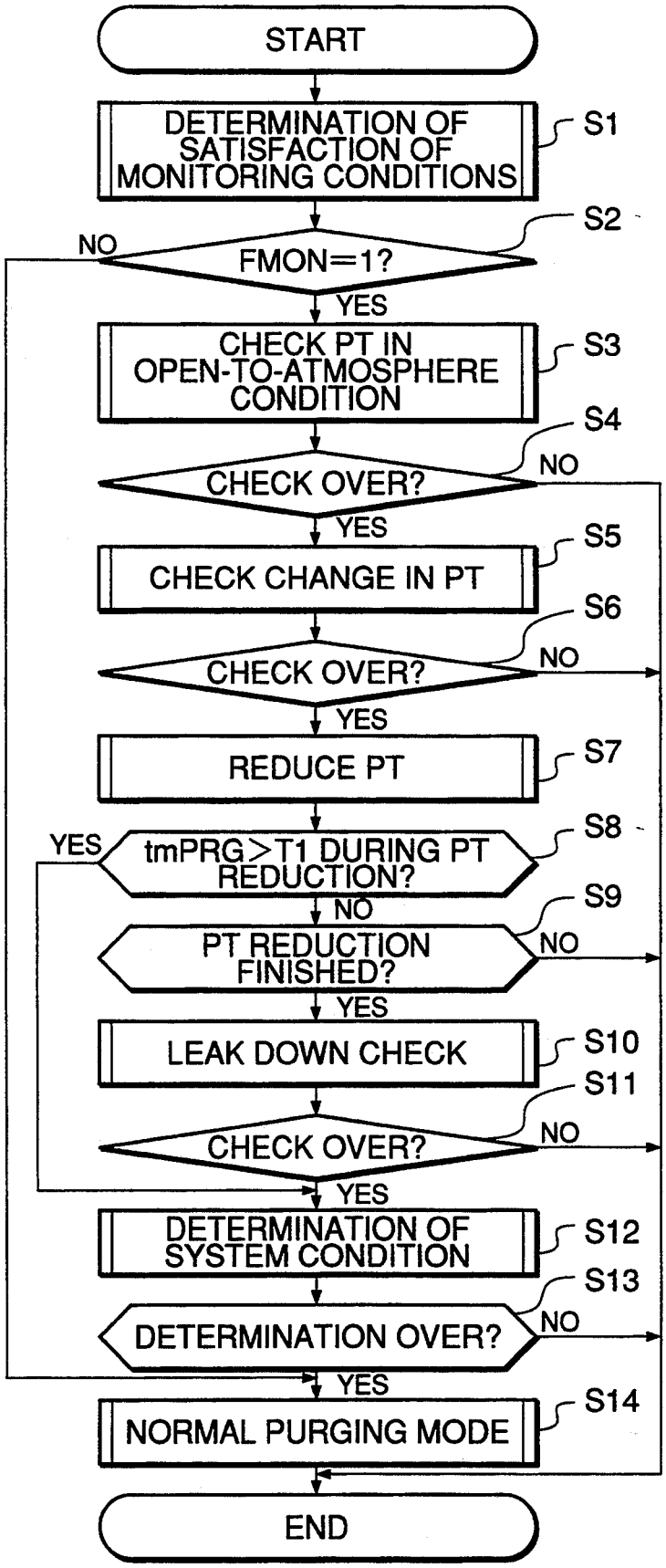
FIG. 3 is a flowchart showing a main program for carrying out determination of abnormality in an evaporative emission control system appearing in FIG. 1, according to the invention.

FIG. 3 shows a program for carrying out the abnormality diagnosis of the evaporative emission control system 11, which is executed by the CPU of the ECU 5.

First, at a step S1, a routine for determining permission for monitoring (determination of fulfillment of abnormality determining conditions) is carried out, as described hereinafter. Then, at a step S2, it is determined whether or not the monitoring of the system 11 for abnormality diagnosis is permitted, i.e. whether or not a flag FMON is set to "1". If the answer to this question is negative (NO), the two-way valve 28, the drain shut valve 38 and the purge control valve 36 are set to respective operative states for normal purging mode of the system at a step S14, followed by terminating the program, whereas if the answer to this question is affirmative (YES), the tank internal pressure PT in the open-to-atmosphere condition of the system is checked at a step S3, and it is determined at a step S4 whether or not this check has been completed. If the answer to this question is negative (NO), the program is immediately terminated, whereas if it is affirmative (YES), i.e. if it is determined that the check of the tank internal pressure has been completed, the two-way valve 28 is closed to check a change in the tank internal pressure PT at a step S5, followed by determining at a step S6 whether or not this check has been completed. If the answer to this question is negative (NO), the program is immediately terminated, whereas if it is affirmative (YES), the evaporative emission control system 11 and the fuel tank 23 are brought into the negatively pressurized state at a step S7.

Simultaneously with the start of the negative pressurization at the step S7, a first timer tmPRG incorporated in the ECU 5 is started, and it is determined at a step S8 whether or not the count value thereof is larger than a value corresponding to a predetermined time period T1. The predetermined time period T1 is set to such a value as ensures that the system 11 is negatively pressurized to a predetermined pressure value, i.e. the negatively pressurized condition of the system 11 is established within the predetermined time period T1 if the system is normal. If the answer to the question of the step S8 is affirmative (YES), it is determined that the system 11 cannot be negatively pressurized to the predetermined pressure value due to a hole formed in the fuel tank 23, etc., and hence the program jumps to a step S12. On the other hand, if the answer to the question of the step S8 is negative (NO), it is determined at a step S9 whether or not the negative pressurization has been completed. If the answer to this question is negative (NO), the program is immediately terminated, whereas if it is affirmative (YES), a leak down check routine, described in detail hereinafter, is carried out at a step S10 to check whether or not the system 11 is properly sealed, i.e. it is free from a leak of evaporative fuel therefrom in the normal operating mode thereof. Then, at a step S11, it is determined whether or not this check has been completed.

If the answer to this question is negative (NO), the program is immediately terminated, whereas if the answer is affirmative (YES), the program proceeds to the step S12.

At the step S12, a determination is made as to whether or not the system 11 is in a normal condition, followed by determining at a step S13 whether or not the determination of the step S12 has been completed. If the answer to this question is negative (NO), the program is immediately terminated, whereas if it is affirmative (YES), the system 11 is set to the normal purging mode at the step S14, followed by terminating the program.

Next, the above steps will be described in detail hereinbelow:

(1) Determination as to Permission of Monitoring (at the step S1 in FIG. 3)

Determination as to permission of monitoring is carried out by determining whether or not detected operating parameters of the engine, such as the engine coolant temperature TW, the intake air temperature TA, the engine rotational speed NE, the intake pipe absolute pressure PBA, the throttle valve opening $\theta$TH, and the vehicle speed VSP are within respective predetermined ranges, whether or not the vehicle is cruising, and whether or not purging of evaporative fuel has been carried out over a predetermined time period. If the above operating parameters are within the respective ranges and the vehicle is cruising, while the purging has been carried out over the predetermined time period, it is determined that the conditions for permission of monitoring, i.e. abnormality determining conditions are satisfied, and the flag FMON is set to "1". If any one of the conditions is not satisfied, the flag FMON is set to "0".

(2) Check of Tank Internal Pressure in Open-to-Atmosphere Condition (at the step S3 in FIG. 3)

Figure 4:
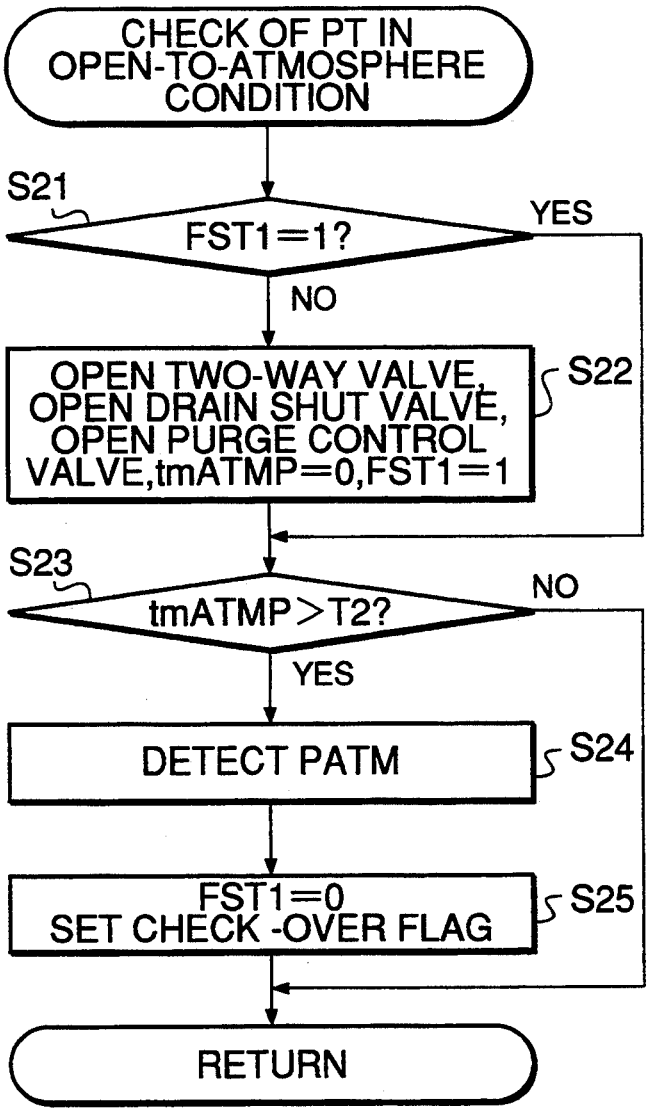
FIG. 4 is a flowchart showing a subroutine for checking the tank internal pressure when the interior of the evaporative emission control system is made open to the atmosphere.

FIG. 4 shows a subroutine for checking the tank internal pressure in the open-to-atmosphere condition, which is executed as a background processing.

First, at a step S21, it is determined whether or not a flag FST1, which indicates that initial setting has been completed and the check has been started, when set to "1", is equal to "1". In the first loop of execution of this routine, FST1="0" stands, and hence the program proceeds to a step S22, while in subsequent loops, FST1="1" stands and then the program skips over the step S22 to a step S23.

At the step S22, the system 11 is set to the open-to-atmosphere mode, and at the same time a second timer tmATMP is reset and started, followed by setting the flag FST1 to "1". More specifically, the two-way valve 28 is held open and at the same time the drain shut valve 38 and the purge control valve 36 are held open. Thus, the tank internal pressure PT is relieved to the atmosphere (see the time period indicated by (2) in FIG. 2).

Then, at a step S23, it is determined whether or not the count value of the second timer tmATMP is larger than a value corresponding to a predetermined time period T2. The predetermined time period T2 is set to a value, e.g. 4 sec, which ensures that the pressure within the system 11 has been stabilized upon lapse thereof. If the answer to this question is negative (NO), the program is immediately terminated, while if it is affirmative (YES), the program proceeds to a step S24, where tank internal pressure PATM in the open-to-atmosphere condition is detected by the PT sensor 29 and stored into the memory means of the ECU 5. Then, the flag FST1 is set to "0" at a step S25, followed by terminating the program.

(3) Check of A Change in Tank Internal Pressure (at the step S5 in FIG. 3)

Figure 5:
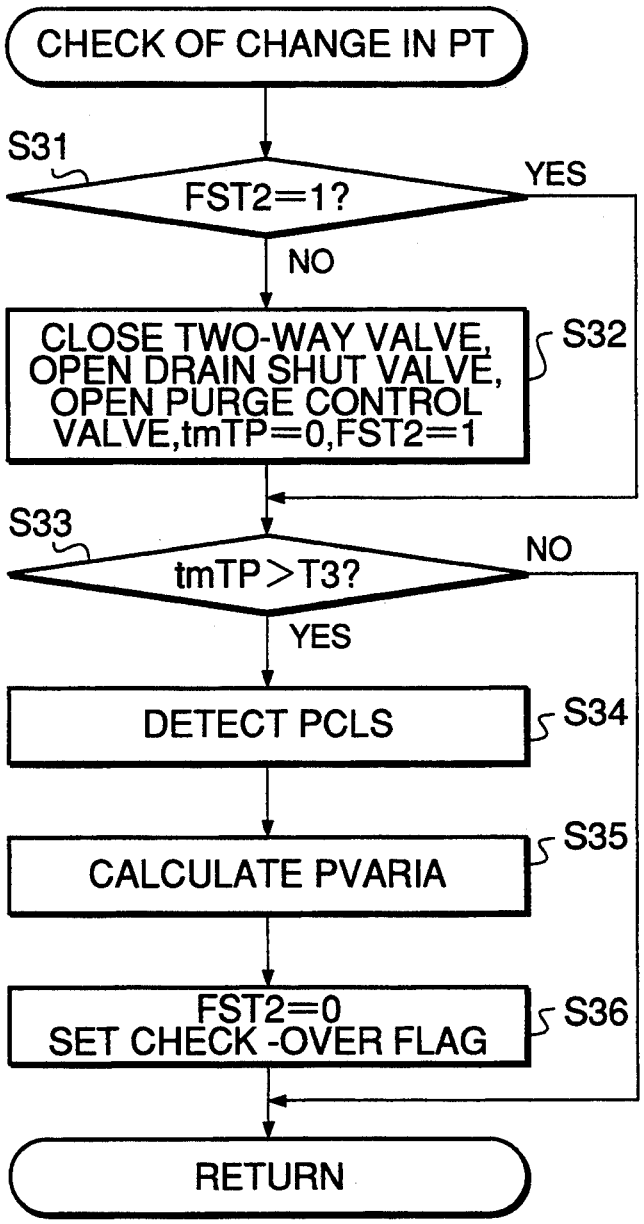
FIG. 5 is a flowchart showing a subroutine for checking a change in the tank internal pressure.

FIG. 5 shows a routine for checking a change in the tank internal pressure, which is executed as a background processing.

First, at a step S31, it is determined whether or not a flag FST2, which indicates that initial setting has been completed and the check has been started, when set to "1", is equal to "1". In the first loop of execution of this routine, FST2="0" stands, and hence the program proceeds to a step S32, while in subsequent loops, FST2="1" stands and then the program jumps to a step S33.

At the step S32, the system 11 is set to a PT change-checking mode, and at the same time a third timer tmTP is reset and started, followed by setting the flag FST2 to "1". More specifically, while the purge control valve 36 and the drain shut valve 38 are held open, the two-way valve 28 is closed, i.e. the electromagnetic driving unit 35 is turned off, to thereby set the system 11 to the PT change-checking mode (see the time period indicated by (3) in FIG. 2).

Then, at a step S33, it is determined whether or not the count value of the third timer tmTP is larger than a value corresponding to a third predetermined time period T3, e.g. 10 sec. If the answer to this question is negative (NO), the program is immediately terminated, whereas if it is affirmative (YES), tank internal pressure PCLS after the lapse of the predetermined time period T3 is detected and stored into the ECU 5 at a step S34, followed by calculation of a first rate of change PVARIA in the tank internal pressure at a step S35 by the use of the following equation (1):

$$PVARIA=(PCLS-PATM)T3 \quad (1)$$

Then, the first rate of change PVARIA thus calculated is stored into the memory means of the ECU 5 and the flag FST2 is set to "0" at a step S36, followed by terminating the program.

(4) Negative Pressurization (at the step S7 in FIG. 3)

Figure 6:
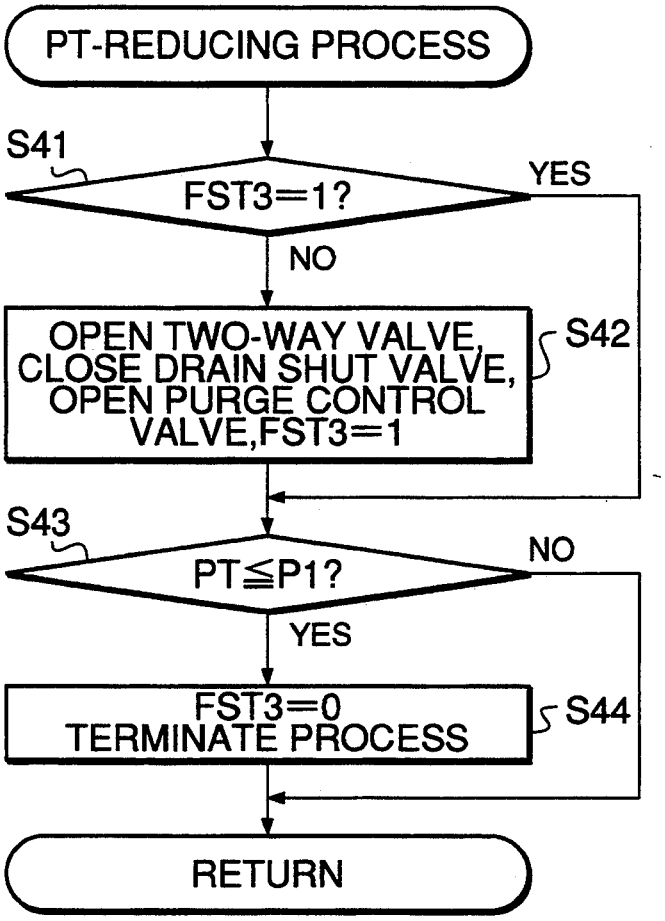
FIG. 6 is a flowchart showing a subroutine for reducing the tank internal pressure.

FIG. 6 shows a routine for carrying out a process of negatively pressurizing the system 11 to establish the negatively pressurized state of the system, which is executed as a background processing.

First, at a step S41, it is determined whether or not a flag FST3, which indicates that initial setting has been completed and the check has been started, when set to "1", is equal to "1". In the first loop of execution of this routine, FST3="0" stands, and hence the program proceeds to a step S42, while in subsequent loops FST3="1" stands and then the program jumps to a step S43.

At the step S42, the system 11 is set to a negatively pressurizing mode, and then the flag FST3 is set to "1". More specifically, the purge control valve 36 is kept open, and at the same time the two-way valve 28 is opened and the drain shut valve 38 is closed (see the time period indicated by (4) in FIG. 2). In this state, the system 11 is negatively pressurized to the predetermined value by a gas-drawing force created by operation of the engine 1. Then, it is determined at the step S43 whether or not the tank internal pressure PT in this mode of the system 11 is lower than a desired pressure value P1. The desired pressure value P1 is set, for example, to a value obtained by subtracting a predetermined pressure value, e.g. 15 mmHg, from the detected value of atmospheric pressure PATM. By setting the desired pressure value P1 in this manner, the influence of an error in the detection of the tank internal sensor can be eliminated. If the answer to the question of the step S43 is negative (NO), the program is immediately terminated, whereas if it becomes affirmative (YES), the flag FST3 is set to "0" at a step S44, followed by terminating the program.

(5) Leak Down Check (at the step S10 in FIG. 3)

Figure 7:
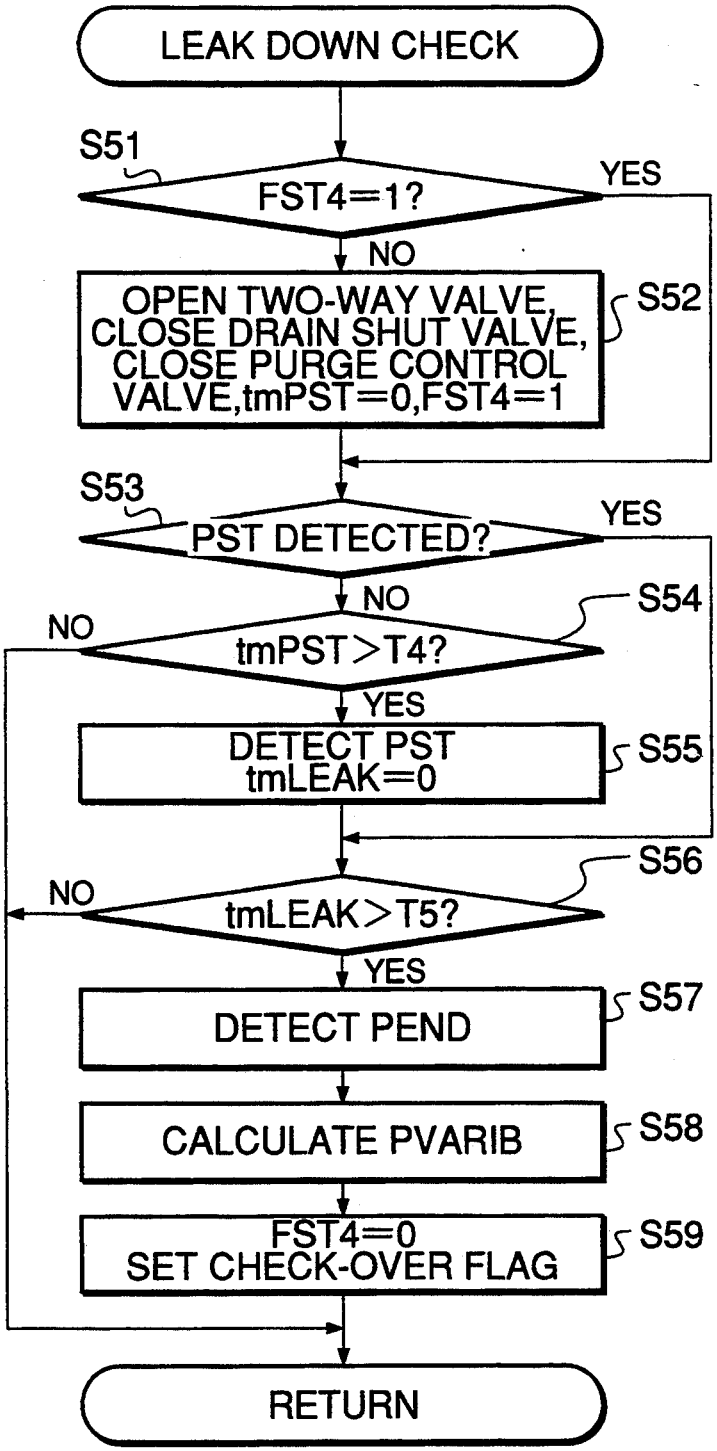
FIG. 7 is a flowchart showing a leak down check subroutine for checking a change rate in the tank internal pressure when the evaporative emission control system is isolated from the intake pipe.

FIG. 7 shows a routine for performing a leak down check of the system 11, which is executed as a background processing.

First, at a step S51, it is determined whether or not a flag FST4, which indicates that initial setting has been completed and the check has been started, when set to "1", is equal to "1". In the first loop of this routine, FST4="0" stands, and hence the program proceeds to a step S52, while in subsequent loops FST4="1" stands and then the program jumps to a step S53.

At the step S52, the system 11 is set to the leak down check mode, and at the same time a fourth timer tmPST is reset and started, followed by setting the flag FST4 to "1". More specifically, while the two-way valve 28 is kept open and the drain shut valve 38 is kept closed, the purge control valve 36 is closed to cut off the communication between the system 11 and the intake pipe 2 of the engine 1 (see the time period indicated by (5) in FIG. 2).

Then, the program proceeds to the step S53, where it is determined whether or not the tank internal pressure at the start of the leak down check (hereinafter referred to as "the starting pressure") PST has been detected. In the first loop of execution of this routine, the answer to the question of the step S53 is negative (NO), so that the program proceeds to a step S54, where it is determined whether or not the count value of the fourth timer tmPST is larger than a value corresponding to a predetermined time period (predetermined delay time) T4. If the predetermined time period T4 has not elapsed, the program is immediately terminated. On the other hand, if the predetermined time period T4 has elapsed, the program proceeds to a step S55, where the pressure PST is detected and a fifth timer tmLEAK is reset and started.

The reason why the detection of the starting pressure PST is delayed by the predetermined time period T4 is as follows: As shown at (d) in FIG. 2, at the time point t4 the tank internal pressure PT decreases to the predetermined negative pressure P1, the pressure PC within the canister 26 (=PCMIN) has decreased to a value lower than the predetermined pressure P1, and therefore the tank internal pressure PT continues to decrease even after the time period t4, and starts to increase only after the time point t5 the tank internal pressure PT becomes substantially equal to the pressure PC within the canister 26. Consequently, if the starting pressure PST is detected at the time point t4, a second rate of change PVARIB in the tank internal pressure, hereinafter referred to, cannot be accurately measured. However, detection of the starting pressure PST at the time point t5 ensures accurate measurement of the second rate of change PRAVIB.

The predetermined time period T4 is set to a time period within which the tank internal pressure PT can become substantially equal to the pressure PC within the canister 26 after the purge control valve 36 is opened for the negative pressurization, in other words, a time period within which substantially the same pressure can come to prevail throughout the system 11.

Then, at a step S56, it is determined whether or not the count value of the fifth timer tmLEAK is larger than a value corresponding to a predetermined time period (predetermined measuring period) T5, e.g. 10 sec. In the first loop of execution of this step S56, the answer to this question is negative (NO), so that the program is immediately terminated.

In the following loop et seq., the answer to the question of the step S53 becomes affirmative (YES), so that the program jumps to the step S56, where it is determined whether or not the count value of the fifth timer tmLEAK is larger than the value corresponding to the predetermined time period T5. If the answer to this question is negative (NO), the program is immediately terminated, whereas if it becomes affirmative (YES), the present tank internal pressure, i.e. the tank internal pressure PEND at the end of the present leak down check is detected and stored into the memory means of the ECU 5 at a step S57, followed by calculation of the second rate of change PVARIB in the tank internal pressure PT at a step S58 by the use of the following equation (2):

$$PVARIB=(PEND-PST)/T5 \quad (2)$$

The second rate of change PVARIB in the tank internal pressure PT thus calculated is stored into the memory means of the ECU 5, and the flag FST4 is set to "0" at a step S59, followed by terminating the program.

(6) System Condition-Determining Process (at the step S12 in FIG. 3)

Figure 8:
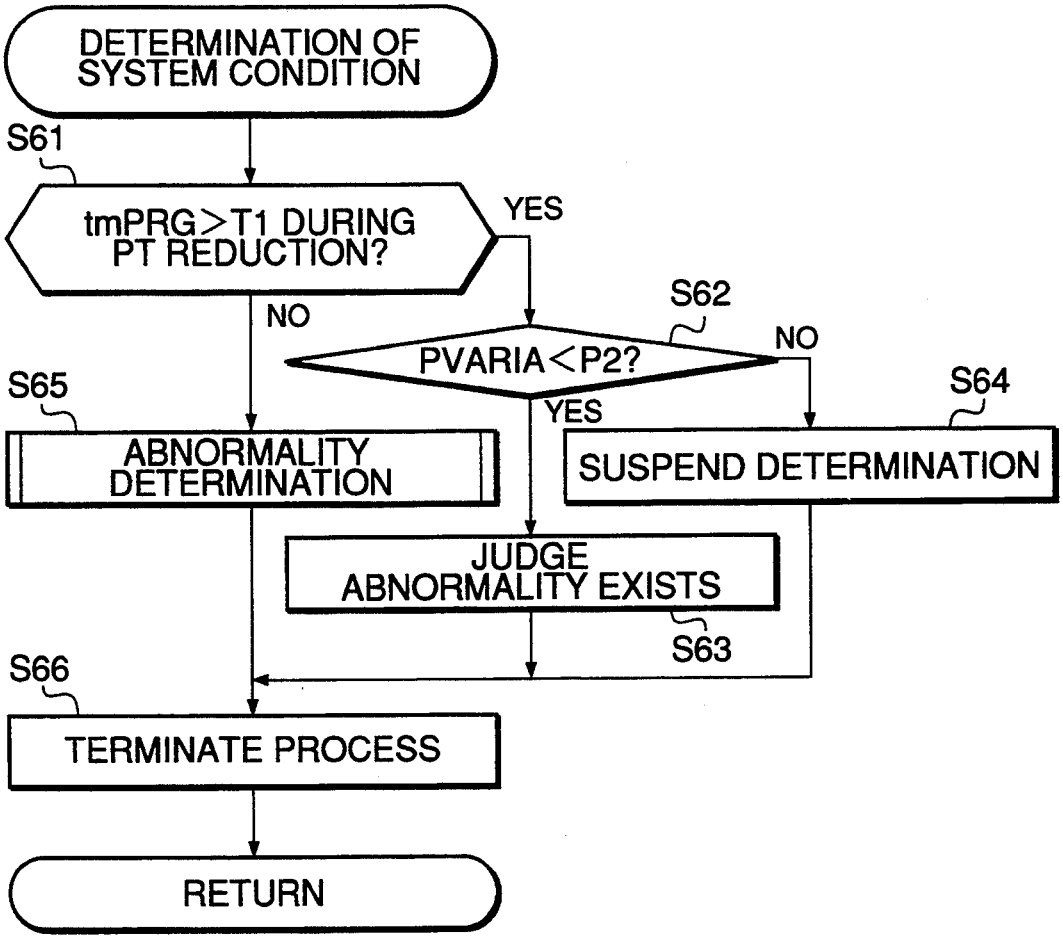
FIG. 8 is a flowchart showing a subroutine for determining a condition of the evaporative emission control system.

FIG. 8 shows a routine for carrying out a process of determining a condition of the system 11, which is executed as a background processing.

First, at a step S61, it is determined whether or not the count value of the first timer tmPRG exceeded the value corresponding to the predetermined value T1 during the negatively pressurizing process. If the answer to this question is affirmative (YES), it is determined that the system 11 may suffer from a significant leak of evaporative fuel due to a hole formed in the fuel tank 23, etc., so that the program proceeds to a step S62, where it is determined whether or not the first rate of change PVARIA in the tank internal pressure PT is smaller than a predetermined value P2. If the answer to this question is affirmative (YES), which means that the rate of increase in the tank internal pressure PT was low during the check of a change in the tank internal pressure PT at (3) in FIG. 2, it is determined that the system 11 suffers from a significant leak of evaporative fuel from the fuel tank 23, piping connections, etc., thereby determining that the system 11 is abnormal, at a a step S63. Then, a process-over flag is set at a step S66, followed by terminating the program. On the other hand, if the answer to the question of the step S62 is negative (NO), which means that evaporative fuel was generated in a large amount in the fuel tank 23 to increase the tank internal pressure PT, which prevented the system 11 from being negatively pressurized in a proper manner in the negatively pressurizing process, the determination of the system condition is suspended at a step S64, and then the process-over flag is set at the step S66, followed by terminating the program.

On the other hand, if the answer to the question of the step S61 is negative (NO), i.e. if the system 11 was negatively pressurized to the predetermined value within the predetermined time period T1, the program proceeds to a step S65, where a predetermined abnormality-determining routine after negative pressurization is carried out, and the process-over flag is set at the step S66, followed by terminating the program.

Figure 9:
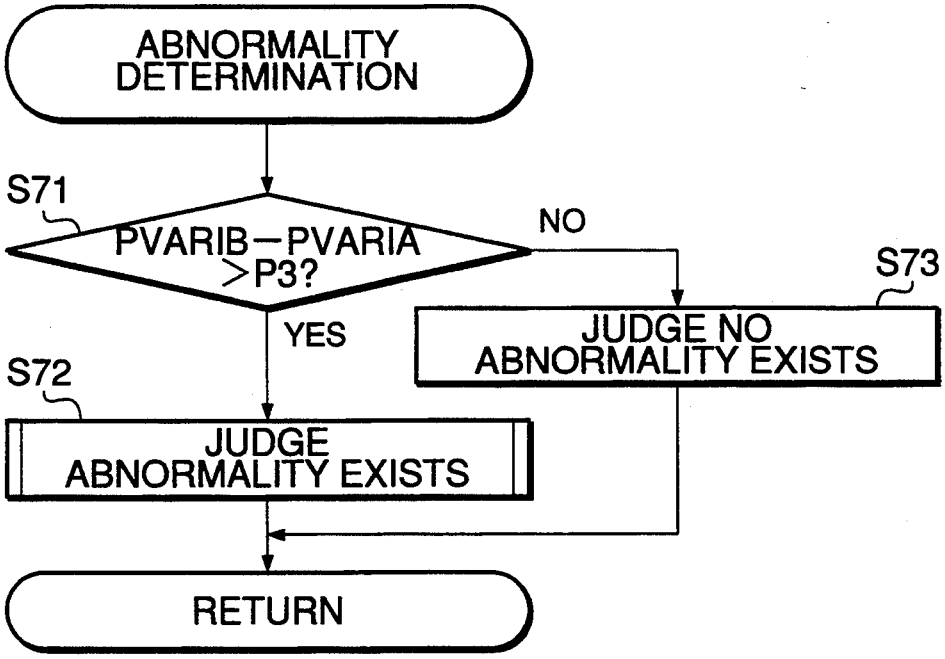
FIG. 9 is a flowchart showing a subroutine for determining abnormality in the evaporative emission control system.

Details of the abnormality-determining routine carried out at the step S65 will be described with reference to a flowchart shown in FIG. 9.

First, it is determined at a step S71 whether or not a difference between the second rate of change PVARIB in the tank internal pressure and the first rate of change PVARIA in the tank internal pressure is larger than a predetermined value P3.

Figure 10:
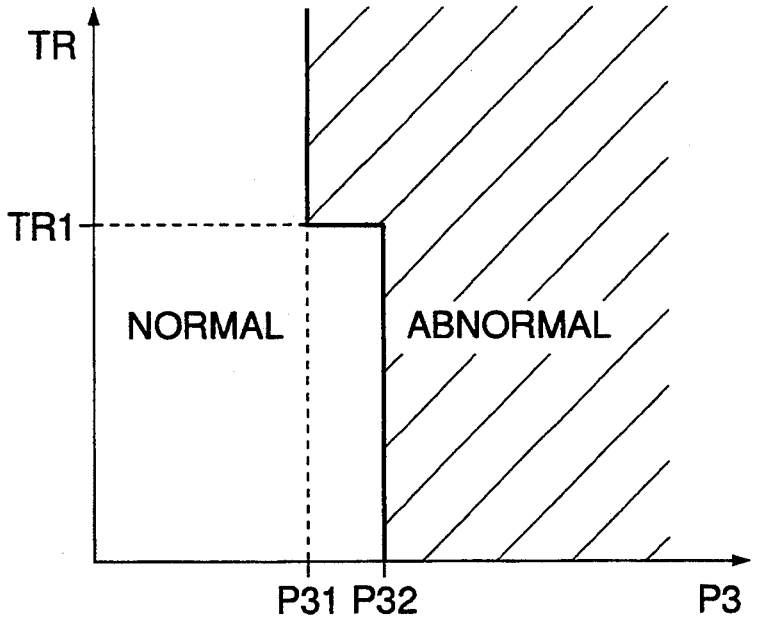
FIG. 10 shows a map used for the abnormality determination.

More specifically, in order to determine whether the second rate of change PVARIB is due to a leak from the evaporative emission control system 11 or due to the amount of evaporative fuel generated within the fuel tank 23, it is determined whether or not the difference between the second rate of change PVARIB and the first rate of change PVARIA is larger than the predetermined value P3. That is, when the second rate of change PVARIB is large due to a large amount of evaporative fuel generated within the fuel tank 23, the answer to the question of the step S71 becomes negative (NO). On the other hand, when the second rate of change PVARIB is large due to a large amount of leak from the emission control system 11, the answer to the question of the step S71 becomes affirmative (YES). The predetermined value P3 is set depending upon the negatively pressurizing time period TR shown in FIG. 10. More specifically, the predetermined value P3 is set to a value "P31" when the negatively pressurizing time period TR is longer than a predetermined time period TR1, whereas it is set to a value "P32" (>P31) when the negatively pressurizing time period TR1 is shorter than the predetermined time period TR. If the answer to the question of the step S71 is affirmative (YES), i.e. if the difference between the second rate of change PVARIB in the tank internal pressure and the first rate of change PVARIA in the tank internal pressure is larger than the predetermined value P3, it is determined at a step S72 that the system 11 is abnormal, i.e. a leak has occurred from the system 11. On the other hand, if the answer to the question of the step S71 is negative (NO), it is determined at a step S73 that the system 11 is normal, followed by terminating the program.

(7) Normal Purging (at the step S14 in FIG. 3)

Figure 11:
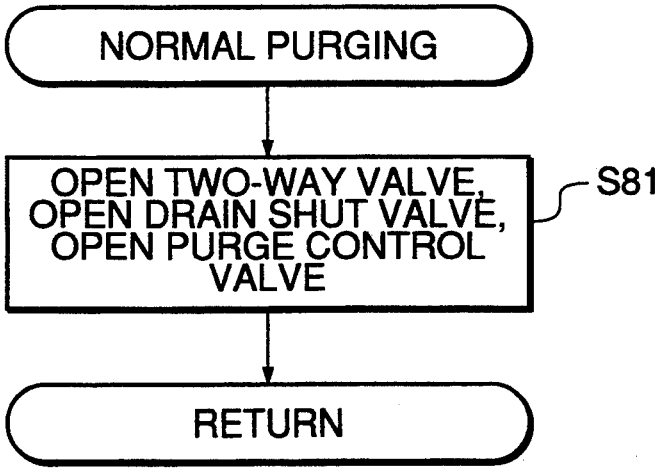
FIG. 11 is a flowchart showing setting conditions of control valves for normal purging.

FIG. 11 shows a subroutine for setting conditions of the control valves in the normal purging mode, according to the present embodiment.

More specifically, at a step S81, the two-way valve 28, the drain shut valve 39 and the purge control valve 36 are opened to thereby set the system to the normal purging mode where drawing of air from the system 11 by the engine 1 is enabled, followed by terminating the program.

As described in detail hereinabove, according to the present invention, the tank internal pressure assumed when the predetermined time period T4 has elapsed from the time point (the time point t4 in FIG. 2) the tank internal pressure PT has reached the predetermined pressure P1 (at the time point t5 in FIG. 2) is set to the starting pressure PST, and the tank internal pressure assumed when the predetermined time T5 has elapsed from the time point t5 is set to the ending pressure PEND, to thereby calculate the second rate of change PVARIB in the tank internal pressure by the use of the equation (2). Therefore, the influence of a decrease in the tank internal pressure PT after the completion of the negative pressurization is eliminated, thereby enabling to obtain an accurate value of the rate of change PVARIB. As a result, the presence/absence of a leak from the emission control system 11 can be more accurately determined.

As a variation of the present embodiment, the PT sensor 29 may be arranged in the fuel-guiding passage 27 at a location between the two-way valve 28 and the fuel tank 23 in place of the upper wall of the tank 23.

Figure 12:
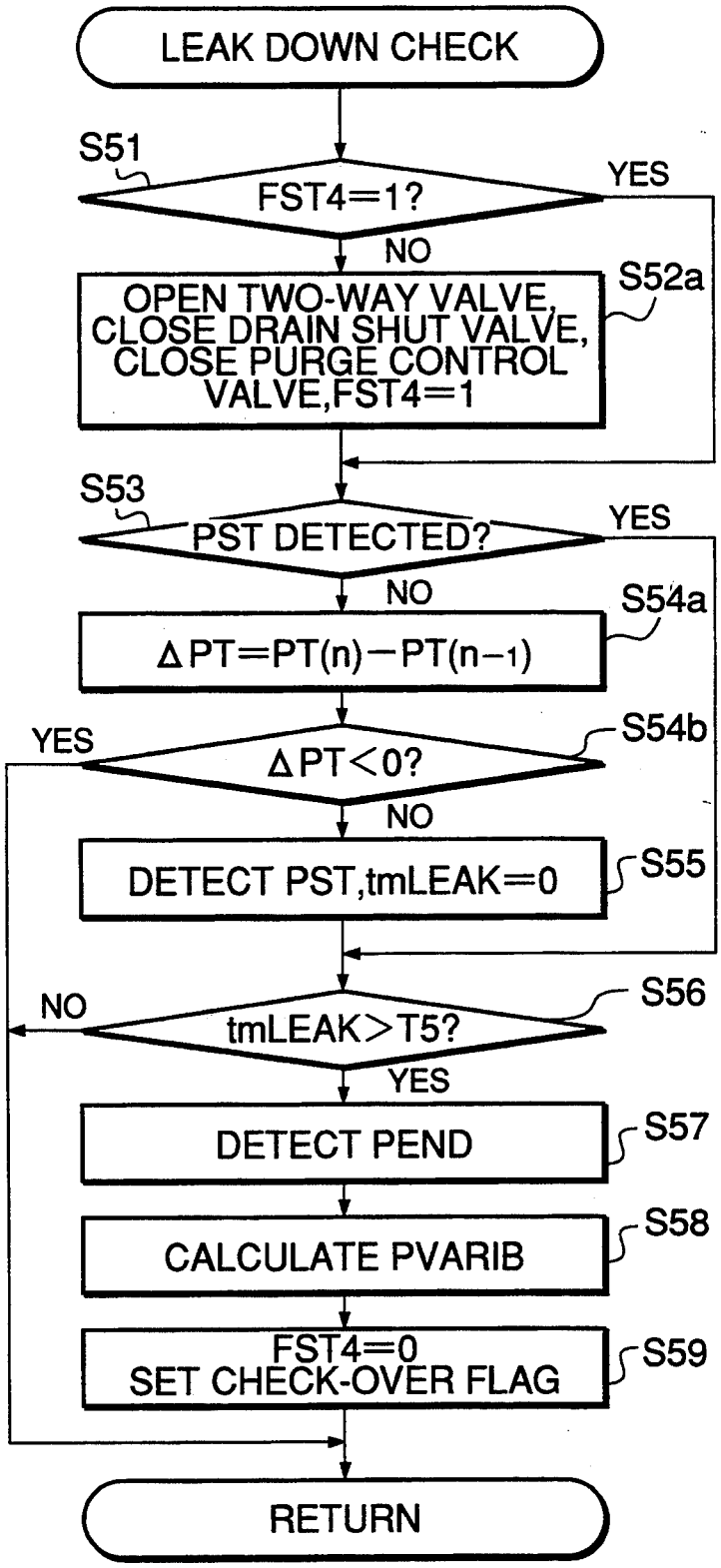
FIG. 12 is a flowchart showing a leak down check subroutine, according to a second embodiment of the present invention.

FIG. 12 shows a routine for performing a leak down check of the system 11 according to a second embodiment of the invention, wherein the steps S52 and S54 in the FIG. 7 program are replaced by steps **S52*a*, and S54*a* and S54*b***, respectively.

In the present embodiment, the fourth timer tmPST is not used, and therefore, at the step **S52*a*, initial setting of the timer is not carried out. At the step S54*a*, an amount of change in the tank internal pressure $\Delta PT$ is calculated from a difference between a presently detected value PT(n) of the tank internal pressure and a last detected value PT(n−1) of the tank internal pressure, and at the following step S54*b*, it is determined whether or not the value $\Delta PT$ is negative. In the first loop of execution of this step, $\Delta PT<0$ stands, and hence the program is immediately terminated. When $\Delta PT \geqq 0$ stands, the program proceeds to the step S55**, where the starting pressure PST is measured.

According to the present embodiment, when the tank internal pressure PT becomes substantially the minimum, i.e. at the time point t5 in FIG. 2, a value PTMIN then assumed is set to the starting pressure PST, thereby enabling to obtain a value of the rate of change PVARIB in the tank internal pressure which is almost as accurate as one in the embodiment of FIG. 7.

Next, a third embodiment of the invention will be described with reference to FIGS. 13 to 15.

Figure 13:
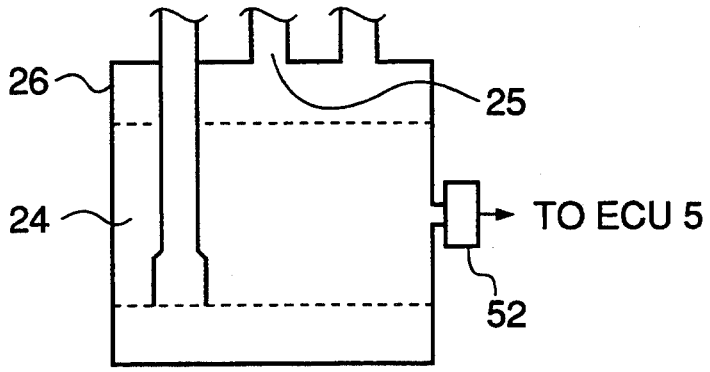
FIG. 13 is a block diagram showing a canister and its related parts of an evaporative fuel-processing system according to a third embodiment of the invention.

In the present embodiment, as shown in FIG. 13, a canister internal pressure sensor 52 is provided at the canister 26 to detect the pressure PC within the canister and supply an output signal indicative of the detected pressure PC to the ECU 5.

Figure 14:
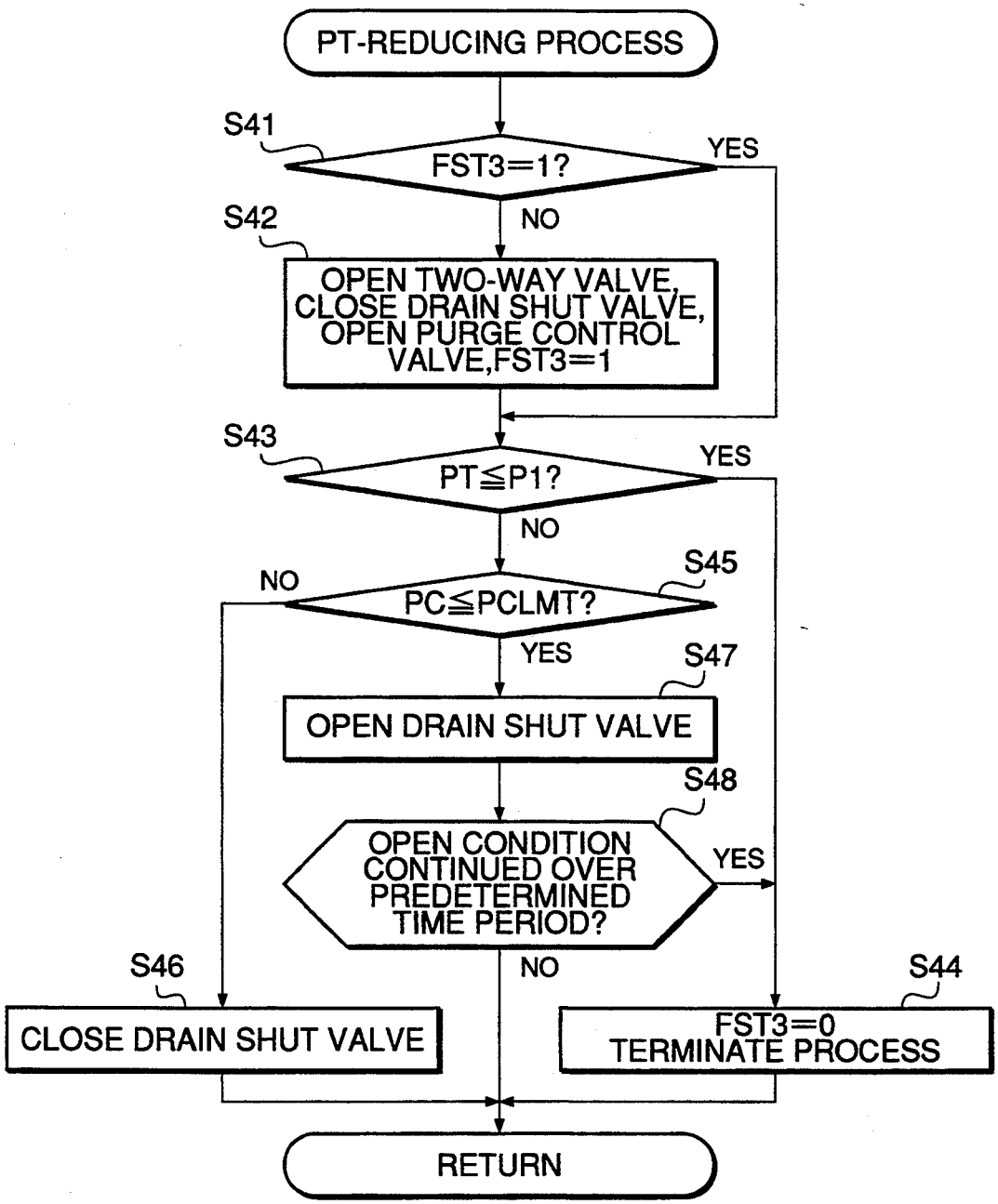
FIG. 14 is a flowchart showing a subroutine for reducing the tank internal pressure, according to the third embodiment.

According to the embodiment, the negative pressurization of the system 11 is carried out a the program shown in FIG. 14. The processings at the steps S41 to S44 are identical with those at the steps S41 to S44 in FIG. 6.

In FIG. 14, if the answer to the question of the step S43 is negative (NO), i.e. if PT>P1 stands, which means that the tank internal pressure PT does not drop to the predetermined pressure P1, it is determined at the step S45 whether or not the pressure PC within the canister 26 is lower than a predetermined lower limit value PCLMT. When PC>PCLMT stands, i.e. the canister pressure PC does not drop to the predetermined lower limit value PCLMT, the drain shut valve 38 is kept closed at the step S46 (see time points t3 to t7 in FIG. 15). Thereafter, when the value PC reaches the predetermined lower limit value PCLMT, the drain shut valve 38 is opened at the step S47 (see the time point t7 in FIG. 15), and then it is determined at the step S48 whether or not the above state has continued over a sixth predetermined time period T6. If the drain shut valve 38 has continued to be open over the sixth predetermined time period T6, which means that the canister pressure PC does not rise in spite of the instructions to open the drain shut valve 38, it is determined that an abnormality has occurred, followed by the program proceeding to the step S44.

Figure 15:
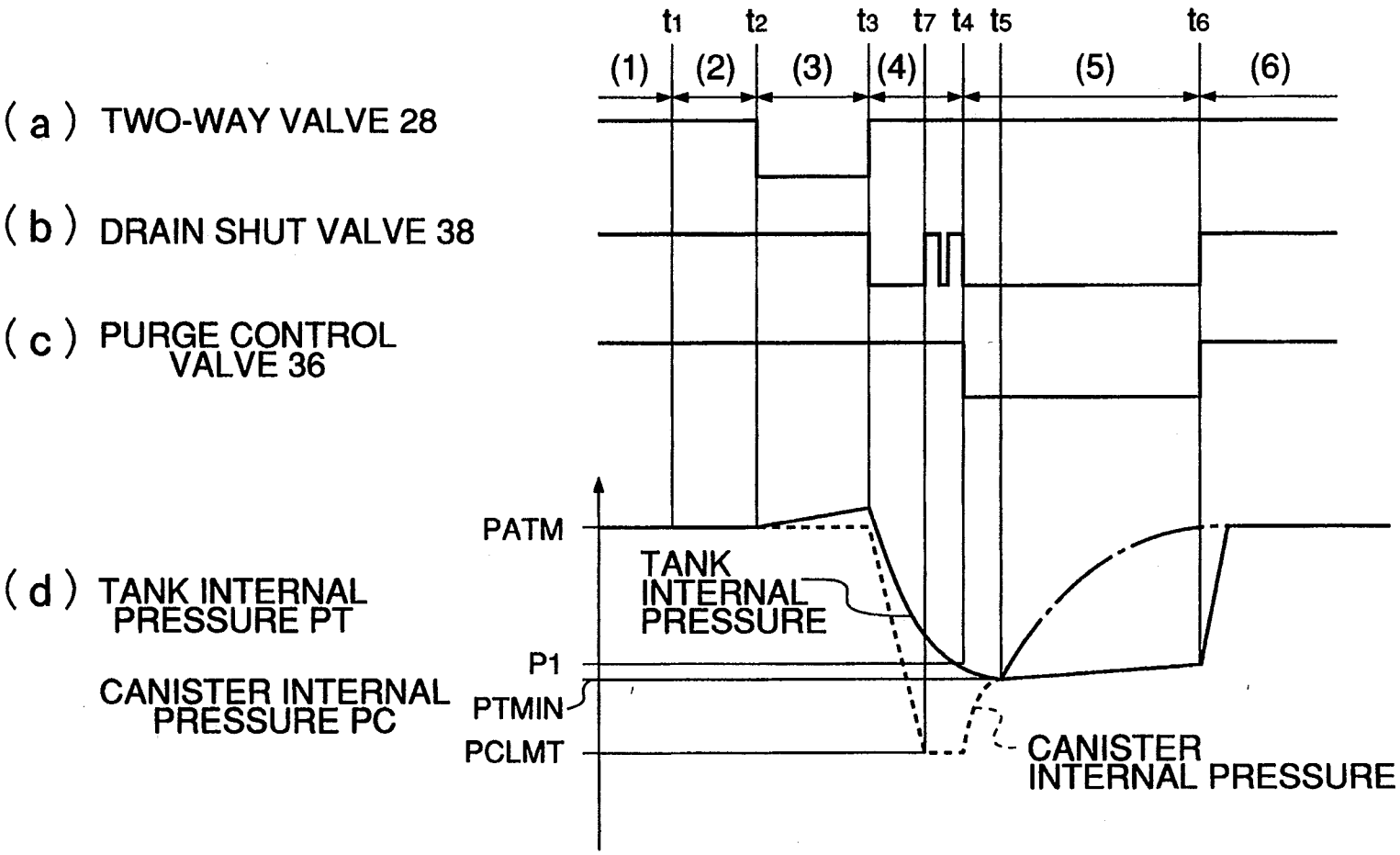
FIG. 15 is a timing chart showing operating patterns of control valves as well as changes in tank internal pressure and pressure within the canister, according to the third embodiment.

According to the program in FIG. 14, as described above, when the canister pressure PC reaches the predetermined lower limit value PCLMT during the negative pressurization, the drain shut valve 38 is controlled to close or open in response to the relationship between PC and PCLMT so as to hold the PC value substantially at the PCLMT value (valving control) (see the time points t7 to t4 in FIG. 15). Thereafter, when the tank internal pressure PT reaches the predetermined pressure P1 at the time point t4 in FIG. 15, the negative pressurization is terminated.

The third embodiment is substantially the same as the first or the second embodiment except for the above described processing. However, the fourth predetermined time period T4 employed in the leak down check of FIG. 7 should be set to a value shorter than that in the first embodiment. This is because in the third embodiment the pressure PC within the canister does not become lower than the lower limit value PCLMT due to the valving control of the drain shut valve, so that a time period required for the pressure PC to become equal to the tank internal pressure PT is shorter than the time period required in the first embodiment.

Alternative of employing the starting pressure PST for the leak down check, which is assumed upon the lapse of the predetermined time period T4, the starting pressure PST for the leak down check may be employed, which is assumed when the difference between the tank internal pressure PT and the canister pressure PC becomes substantially zero, since in the present embodiment the canister pressure PC is detected by the sensor 52 so that the detected PC value can be compared with the detected PT value.

According to the present embodiment, by virtue of the control of the canister pressure PC, the canister pressure PC and the tank internal pressure PT will not excessively drop, i.e. the evaporative emission control system 11 will not be negatively pressurized to an excessive degree, resulting in increased reliability of the evaporative emission control system 11.

Although in the above described embodiments, the presence/absence of a leak from the system 11 is determined based on the tank internal pressure PT, this is not limitative. For example, the canister internal pressure sensor 52 may be provided as in the third embodiment, and a value of a parameter corresponding to the second rate of change PVARIB in the tank internal pressure may be calculated based on the canister pressure PC to thereby determine the presence/absence of a leak from the system 11, because, as shown in FIG. 15, the canister pressure PC and the tank internal pressure PT assume substantially the same value after the time point t5.

Further, the presence/absence of a leak from the system 11 may be determined only based on the output from the canister internal pressure sensor 52 without using the tank internal pressure sensor 29. In such an alternative case, negative pressurization is carried out until the detected pressure value from the canister internal pressure sensor 52 becomes lower by a predetermined pressure value than the detected pressure value therefrom assumed when the system 11 is in the open-to-air condition. Then, a rate of increase in the canister pressure PC is detected at a time point the predetermined time period T4 has elapsed from the completion of the negative pressurization, and when the detected rate of increase in the pressure PC is larger than a predetermined value, it is determined that a leak has occurred from the system 11.

Figure 16:
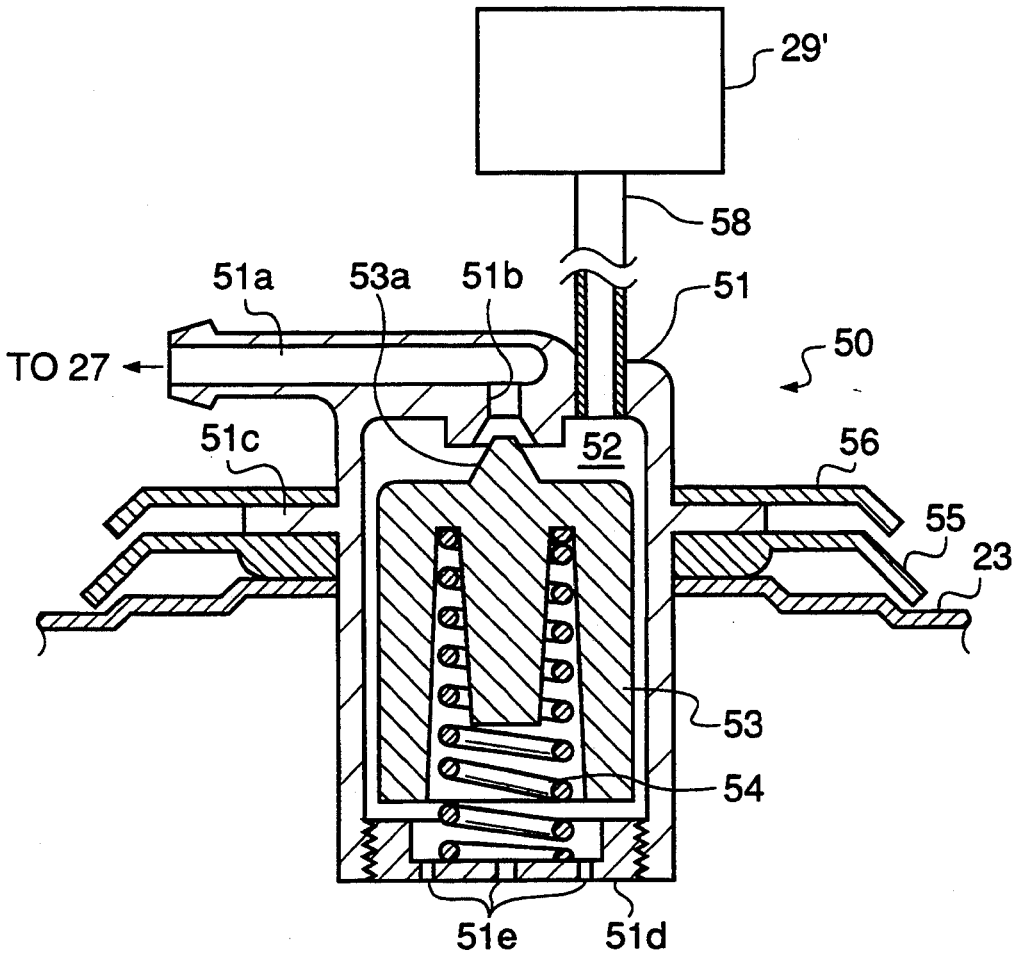
FIG. 16 is a cross-sectional view of a cut-off valve employed in an evaporative fuel-processing system according to a fourth embodiment of the invention.

FIG. 16 shows a cut-off valve 50 and a tank internal pressure sensor (PT sensor) 29 which are employed in an evaporative fuel-processing system according to a fourth embodiment of the invention. This embodiment is distinguished from the first to third embodiments, only in the mounting of the tank internal pressure-sensor. The cut-off valve 50 is interposed between the fuel tank 23 and the fuel-guiding passage 27, and the PT sensor 29' is connected to the valve 50 via a communication passage 58.

The cut-off valve 50 comprises a valve casing 51 defining a valve casing chamber 52 therein, a float valve 53 accommodated within the valve casing chamber 52, and a spring 54 for urging the float valve 53 in a valve closing direction. The valve casing 51 has a connecting passage **51*a* formed therein and connected to the fuel-guiding passage 27, a flange 51*c*, and a bottom wall 51*d* having a plurality of through holes 51*e*** formed therein.

The flange **51*c* of the valve casing 51 is fixed to an upper wall of the fuel tank 23 by means of a plate member 56, and a sealing rubber member 55 interposed between the upper wall of the fuel tank 23 and the flange 51*c*. The valve casing chamber 52 communicates with the connecting passage 51*a* via a valve hole 51*b* which is disposed to be closed by an integral protrusion 53*a* of the float valve 53. The communication passage 58 extends at one end through an upper wall of the valve casing 51 into the valve casing chamber 52, and at the other end of which is mounted the PT sensor 29'** in communication therewith.

The cut-off valve 50 is arranged at such a location (0B point) relative to the fuel tank 23 that it is not soaked in fuel (in liquid phase) within the tank when the angle of inclination of the fuel tank 23 is within a predetermined angle, so that the pressure within the valve casing chamber 52 is not likely to be affected by a motion of fuel within the fuel tank.

If the fuel tank 23 inclines to by an angle larger than the predetermined angle, the float valve 53 is lifted by the liquid fuel so that the protrusion **53*a* of the float valve 53 closes the valve hole 51*b*, thereby closing the cut-off valve 50 to prevent the liquid fuel from entering the connecting passage 51*a***.

Therefore, the output (detected pressure) from the PT sensor 29' is not likely to be affected by the movement of liquid fuel within the fuel tank, as distinct from a conventional arrangement that the PT sensor 29 is arranged directly at the upper portion of the fuel tank 23, thereby enabling to more accurately detect the tank internal pressure.

What is claimed is:

1. In an evaporative fuel-processing system for an internal combustion engine having a fuel tank, and an intake system, including an evaporative emission control system formed by said fuel tank, a canister having an air inlet port formed therein and communicating with the atmosphere, said canister accommodating an adsorbent for adsorbing evaporative fuel generated within said fuel tank, a first passage connecting between said canister and said fuel tank, a second passage connecting between said canister and said intake system of said engine, and a purge control valve arranged across said second passage, a drain shut valve for opening and closing said inlet port of said canister, pressure-detecting means for detecting pressure within said evaporative emission control system, negatively pressurizing means for negatively pressurizing said evaporative emission control system by introducing negative pressure from said intake system of said engine into said evaporative emission control system by opening said purge control valve and closing said drain shut valve, to thereby bring said evaporative emission control system into a predetermined negatively pressurized state, and then closing said purge control valve to complete said negative pressurization, and leak-detecting means for detecting presence/absence of a leak from said evaporative emission control system, based on a rate of decrease in negative pressure within said evaporative emission control system after said closing of said purge control valve, the improvement comprising delay means for causing said leak-detecting means to start operating when said pressure within said evaporative emission control system becomes substantially equal throughout said evaporative emission control system after the completion of said negative pressurization by said negatively pressurizing means.

2. An evaporative fuel-processing system as claimed in claim 1, wherein said delay means causes said leak-detecting means to start operating when a predetermined delay time period elapses after the completion of said negative pressurization by said negatively pressurizing means, said predetermined delay time period being equal to a time period within which said pressure within said evaporative emission control system can become substantially equal throughout said evaporative emission control system after the completion of said negative pressurization.

3. An evaporative fuel-processing system as claimed in claim 1, wherein said pressure-detecting means comprises at least one of tank internal pressure-detecting means for detecting pressure within said fuel tank and canister internal pressure-detecting means for detecting pressure within said canister.

4. An evaporative fuel-processing system as claimed in claim 3, wherein said predetermined delay time period is equal to a time period within which said pressure within said fuel tank detected by said tank internal pressure-detecting means and said pressure within said canister detected by said canister internal pressure-detecting means can become substantially equal to each other after the completion of said negative pressurization by said negatively pressuring means.

5. An evaporative fuel-processing system as claimed in claim 1, wherein said pressure-detecting means comprises tank internal pressure-detecting means for detecting pressure within said fuel tank, said delay means causing said leak-detecting means to start operating when a change in said pressure within said fuel tank detected by said tank internal pressure-detecting means changes in direction from a negative direction to a positive direction after the completion of said negative pressurization by said negatively pressuring means.

6. An evaporative fuel-processing system as claimed in claim 1, wherein said negatively pressurizing means operates until said pressure within said evaporative emission control system detected by said pressure-detecting means becomes lower by a predetermined pressure value than a value of said pressure within said evaporative emission control system assumed when an interior of said evaporative emission control system is open to the atmosphere.

7. An evaporative fuel-processing system as claimed in claim 1, wherein said leak-detecting means detects presence/absence of a leak from said evaporative emission control system, based on a value of said pressure within said evaporative emission control system assumed at the start of operation of said leak-detecting means and a value of said pressure within said evaporative emission control system assumed after a predetermined time period elapses after the start of operation of said leak-detecting means.

8. An evaporative fuel-processing system as claimed in claim 1, wherein said pressure-detecting means comprises tank internal pressure-detecting means for detecting pressure within said fuel tank, and canister internal pressure-detecting means for detecting pressure within said canister, said evaporative emission control system further including canister internal pressure control means responsive to an output from said tank internal pressure-detecting means and an output from said canister internal pressure control means, for controlling said pressure within said canister to a predetermined lower limit value thereof when said pressure within said fuel tank detected by said tank internal pressure-detecting means is higher than a predetermined value during said negative pressurization by said negatively pressurizing means.

* * * * *